US005950705A

United States Patent [19]

Huang

[11] Patent Number: 5,950,705

[45] Date of Patent: Sep. 14, 1999

[54] METHOD FOR CASTING AND CONTROLLING WALL THICKNESS

[75] Inventor: Shyh-Chin Huang, Latham, N.Y.

[73] Assignee: General Electric Company, Schenstady, N.Y.

[21] Appl. No.: 08/758,330

[22] Filed: Dec. 3, 1996

[51] Int. Cl.[6] ..... B22D 33/04; B22C 9/04

[52] U.S. Cl. ..... 164/137; 164/516; 164/35; 164/122.1

[58] Field of Search ..... 164/137, 122.1, 164/516, 361, 35

[56] References Cited

U.S. PATENT DOCUMENTS 5,295,530 3/1994 O'Connor et al. ..... 164/137
5,623,985 4/1997 Wheaton et al. ..... 164/516

*Primary Examiner*—Harold Pyon
*Assistant Examiner*—I. H. Lin
*Attorney, Agent, or Firm*—Ernest G. Cusick; Noreen C. Johnson

[57] ABSTRACT

A method for casting a turbine bucket with at least one surface cooling hole. The method comprises positioning at least one preformed spacer device on a core, where the preformed spacer device is formed of ceramic materials and comprises opposed end plates and at least one interconnecting crossover pin connecting the end plates; forming a layer of temporary material, such as wax, over the core and around the at least one preformed spacer device; forming a shell mold over the layer of temporary material to cover it, the core and the at least one preformed spacer device. The shell mold is maintained stably positioned and spaced from the core by the at least one preformed spacer device, which connects and maintains the shell mold and the core as a stable body. The wax is removed to form a casting space for the turbine bucket between the shell mold and the core and around the at least one preformed spacer device. A liquid metal material, is placed into the casting space between the shell mold and the core and around the at least one preformed spacer device. Once the liquid metal material has hardened, the shell mold, the core and the at least one preformed spacer device, are removed to form the cast turbine bucket having the wall. The removal of the at least one preformed spacer device creates the at least one nozzle on the surface of the turbine bucket.

14 Claims, 9 Drawing Sheets

METHOD FOR CASTING AND CONTROLLING WALL THICKNESS

BACKGROUND OF THE INVENTION

1. Field of the Invention

The invention is directed to a method for controlling the thickness of walls during casting. In particular, the method controls the wall thickness for a turbine, for example an internally cooled turbine of the bucket and nozzle type.

2. Description of Related Art

Current casting methods for large power generation engine buckets and nozzles do not result in a wall with a sufficient thickness with acceptable tolerances. In one known method for casting engine buckets and nozzles, a core is supported inside a mold, for example by a set of core locator devices. Each core device can comprise an indentation on the core and a protrusion on the mold. The indention and protrusion are at positions that correspond to each other. However, this type of core locator device does not provide a sufficient wall thickness, with acceptable tolerances, to satisfy the demands made on power generation engine buckets and nozzles, particularly large power generation engine buckets and nozzles.

In a further method for casting of relatively small turbine structures, such as those in small aircraft engines, a core is typically set inside a mold by a series of pins, for example constructed at least in part of platinum. However, even according to this method, the platinum pins do not provide a sufficient strength to support large cores in the casting of large power generation engine buckets and nozzles.

SUMMARY OF THE INVENTION

It is well known that the efficiency of a gas turbine is related to the operating temperature of the turbine and may be increased by increasing the operating temperature. As a practical matter, however, the maximum turbine operating temperature is limited by high temperature capabilities of various turbine elements. Since the engine efficiency is limited by temperature considerations, turbine designers have expended considerable effort toward increasing the high temperature capabilities of turbine elements, particularly the airfoil shaped vanes and buckets upon which high temperature combustion products impinge. Some increase in engine efficiency has been obtained by the development and use of new materials capable of withstanding higher temperatures. These new materials are not, however, generally capable of withstanding the extremely high temperatures desired in modern gas turbines. Therefore, various cooling arrangements, systems and methods have been developed for extending upper operating temperature limits by keeping airfoils at lower temperatures. This provides the material of the airfoils with an increased ability to withstand without pitting or burning out.

The cooling of airfoils is generally accomplished by providing internal flow passages within the airfoils. These passages accommodate a flow of cooling fluid, where the cooling fluid is generally compressed air. The cooling fluid is bled from either a compressor or combustor.

It is also known that the theoretical possible engine efficiency is reduced by the extraction of cooling air. Therefore, the cooling air should be effectively utilized, lest the decrease in efficiency caused by the extraction of the air be greater than the increase in efficiency resulting form the higher turbine operating temperature. In other words, the cooling system should be efficient from the standpoint of minimizing the quantity of cooling air required.

It is important that all portions of the turbine airfoils be adequately cooled. In particular, adequate cooling should be provided for leading and trailing edges of the airfoils, because these portions are normally the most adversely effected by high temperature combustion gases. It has been determined that known cooling configurations tend to inadequately cool the airfoils, especially at leading and trailing edges of the airfoils. Cooling systems that utilize minimum quantities of cooling air commonly fail to adequately cool all portions of the airfoil. As a result, a critical portion of the airfoil, such as the leading edge, may burn out, crack or pit after a relatively short operating period.

On the other hand, systems that adequately cool most portions of the airfoil, including the leading and trailing edges, normally require too much cooling fluid, such as air, for an efficient overall engine performance. This is due to the cooling air not being efficiently used. For example, an inefficient arrangement may direct cooling air through an interior of the airfoil, and result in the creation of low convection heat transfer coefficients or low heat transfer rates. Further, inadequate heat transfer areas can also cause ineffective use of cooling air.

The cooling configuration chosen for the airfoil should maintain a structural integrity and strength of the airfoil without overly complicating its design and thus its manufacturing costs. In turbine buckets, which are airfoils carried by a high speed turbine rotor, these requirements can be very difficult to provide in combination with a cooling scheme that is theoretically efficient and effective.

To more readily understand these difficulties, it should be noted that, during operation of typical gas turbine engines, total stress levels within the turbine buckets can reach stress magnitudes much higher than those ordinarily experienced by stationary stator vanes. Therefore, it is important that the structural strength and integrity of the buckets be maintained to prevent a serious or even catastrophic failure during engine operation. However, it is also important that an appropriate cooling system be included in the airfoil, be efficient for cooling lowly stressed stator vanes, which are not necessarily suitable for turbine buckets because of the arrangements of the cooling passages. These cooling passages may adversely affect the integrity and strength of the buckets.

The cooling passages can extend from a passage in an interior of the airfoil to an outside surface to form a surface cooling hole. However, the formation of a surface cooling hole should also maintain the wall at an appropriate thickness, with acceptable tolerances, to provide adequate strength to the airfoil, where the wall thickness is defined between a core and mold used to form the airfoil.

Accordingly, one object of the invention is directed to a method for accurately forming and controlling a wall thickness within acceptable tolerances. This method is especially useful in bucket and nozzle constructions for internally cooled gas turbines and large power generation engines, while permitting the formation of surface film cooling holes.

According to another object of the invention, a method for forming surface cooling holes in provided. The surface cooling holes are formed on an outside surface of the cast article.

The method, in accordance with one preferred embodiment of the invention comprises using one or more prefabricated or preformed ceramic spacer devices to define a space between the core and mold. The core and mold are used, in conjunction with the preformed ceramic spacer device or devices, to form the bucket structure, while the preformed ceramic spacer device or devices are used to form surface cooling holes.

In accordance with another object of the invention, a preformed ceramic spacer device comprises opposed end plates and at least one interconnection crossover pin interconnecting the plates to form the preformed ceramic spacer device. The preformed ceramic spacer device is positioned against a core and a temporary forming material, such as wax, can be positioned with the preformed ceramic spacer device, between the plates. A mold is then placed on the wax, by any appropriate manner, to form an device including the core, spacer or spacers, wax and mold. The wax can then be removed, for example by a melting process to form a cavity for the cast product. A liquid metal can be poured into the cavity to form the cast product. The preformed ceramic spacer device, including the plates and crossover pins, are then removed to form cast product, inclusive of surface film cooling holes on the outside surface of the cast product.

In accordance with another object of the invention, the preformed ceramic spacer device can comprise any number of interconnecting crossover pins located between the plates. In each preformed ceramic spacer device, the number of crossover pins can be one or more, where the number is dependent on the ultimate intended use of the cast product. The number of preformed ceramic spacer devices used can vary depending on the size, configuration and intended use of the cast product. Further, the shape and configuration of the preformed ceramic spacer device can vary depending on the shape and use of the cast product.

It is another object of the invention to provide a method for casting and controlling a wall thickness, especially in bucket and nozzle constructions in internally cooled gas turbines and large power generation engines.

Another object of the invention is to provide a method using at least one preformed ceramic spacer device to positively and accurately position a core and mold during formation of a cast product. Therefore, a wall of a formed cast product can have a predetermined thickness, within acceptable tolerances.

A further object of the invention is to provide a method for casting and controlling a wall thickness, within acceptable tolerances. The method also permits the formation of surface film cooling holes in bucket and nozzle constructions.

A still further object to the invention is to provide a method for casting and controlling a wall thickness, especially to form bucket and nozzle constructions, where the method uses a preformed spacer device, which may be formed including wax, to form a cast product.

As known, wall thickness is an important factor that can limit the performance of internally cooled gas turbine buckets, blades and vanes. If the wall is too thick, the temperature gradient is too severe and the performance of the bucket may be hampered. If the wall is too thin, the strength of the bucket will be reduced, which is not desirable. The wall thickness is difficult to control since the thickness is defined by two separate and normally remote, unconnected pieces, a mold and a core. Therefore, according to still another object the invention, a preformed ceramic spacer device is provided to define the spacing between a core and mold. This accurately provides for wall thickness in an airfoil structure. The preformed ceramic spacer device defines the space for an article to be cast and improves the formation of surface film cooling holes.

While the invention is described for use in large power generation engine buckets and nozzles, such as internally cooled gas turbine buckets and nozzles, the invention has applications to casting processes that require precise spacing of cores and molds to form well defined products with controlled thicknesses.

These and other objects, advantages and salient features of the invention will become apparent from the following detailed description, which, when taken in conjunction with the annexed drawings, discloses preferred embodiments of the invention.

BRIEF DESCRIPTION OF THE DRAWINGS

While the novel features of this invention are set forth in the following description, the invention will now be described from the following detailed description of the invention taken in conjunction with the drawings, in which.

DETAILED DESCRIPTION OF THE EMBODIMENTS

The thickness of a wall is an important factor, which can limit the performance of internally cooled gas components, such as, but not limited to, buckets, blades and vanes. If the wall is too thick, the temperature gradient across it is too severe and performance of the bucket may be hampered. If the wall is too thin, the strength of the bucket will be reduced, which, of course, is not desirable. The wall thickness in a bucket is difficult to control, since the thickness is defined by two separate and normally remote, unconnected pieces, a mold and a core.

Thus, in accordance with the invention, a preformed ceramic spacer device is used in the formation of walls for turbine buckets, blades and vanes. The preformed ceramic spacer devices are provided to define the spacing between a core and mold to accurately define a wall thickness. The preformed ceramic spacer device defines the space for the article to be cast and improves the formation of surface film cooling holes.

FIGS. 1–6 and 9 illustrate various preferred embodiments and structures for preformed ceramic spacer devices, in accordance with the invention. The preformed ceramic spacer devices can be formed from any appropriate ceramic material. Each separate component of a preformed ceramic spacer device (to be described hereinafter) may be formed of the same ceramic, different ceramic materials or combination of like and different ceramic materials.

Further, each preformed ceramic spacer device can be formed from a single integral and unitary piece or from separate and distinct components, which are joined together. If the preformed ceramic spacer device is formed from separate and distinct components, the components may be joined together in any appropriate manner, including but not limited to, joining by molding together; joining by connecting with glues, adhesives or welding; and connecting by mechanical connections, such as fasteners, bolts, screws and other structures.

In general, the preformed ceramic spacer device comprises opposed end plates and at least one interconnecting crossover pin between the plates. This forms the preformed ceramic spacer device, in accordance with the invention.

Figure 1:
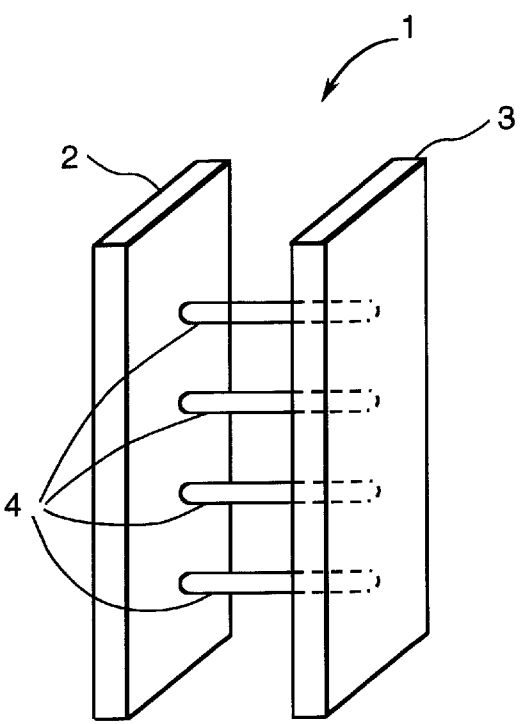
FIG. 1 is a side perspective view of a preformed ceramic spacer device, in accordance with a first preferred embodiment of the invention.

FIG. 1 illustrates a first preferred embodiment of the preformed ceramic spacer device, in accordance with the invention. In FIG. 1, the preformed ceramic spacer device 1 comprises opposed end plates 2 and 3, which are connected by a series of interconnecting crossover pins 4. The series of interconnecting crossover pins 4 are circular in cross-section. However, as explained below especially with reference to the further preferred embodiments of the invention, the cross-sections of the interconnecting crossover pins can be any suitable shape, as long as it maintains its structural integrity.

In FIG. 1 (and the other illustrations of the preferred embodiments), the individual pins of the series of interconnecting crossover pins 4 are formed in a row or column, dependent on the orientation of the preformed ceramic spacer device. Each of pin in the series of interconnecting crossover pins 4 generally orthagonally intersects the plates 2 and 3 at substantially right angles. However, as explained below (especially with reference to the further preferred embodiments of the invention), the positioning of each pin of the series of interconnecting crossover pins 4 can take any suitable orientation, spacing, distribution and size, as long as the preformed ceramic spacer device maintains its structural integrity. Further, the interconnecting crossover pins can be formed in any appropriate structure, such as, for example, tubular, solid or combinations of tubular and solid.

Figure 2:
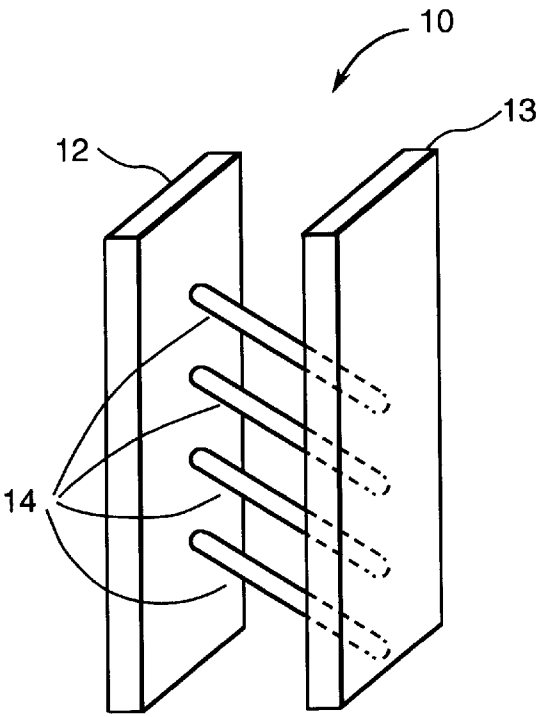
FIG. 2 is a side perspective view of a preformed ceramic spacer device, in accordance with a second preferred embodiment of the invention.

FIG. 2 illustrates a second preferred embodiment of the preformed ceramic spacer device in accordance with the invention. In FIG. 2, the preformed ceramic spacer device 10 comprises opposed end plates 12 and 13, which are connected by a series of interconnecting crossover pins 14. The series of interconnecting crossover pins 14 are circular in cross-section and illustrated as aligned in a row, as in the first preferred embodiment. However, each of pin in the series of interconnecting crossover pins 14 intersects the plates 12 and 13 at non-right angles. This non-right angle intersection permits the preformed ceramic spacer device to be formed in many configurations. This permits a reduction in the length of the interconnecting crossover pins 14.

Figure 3:
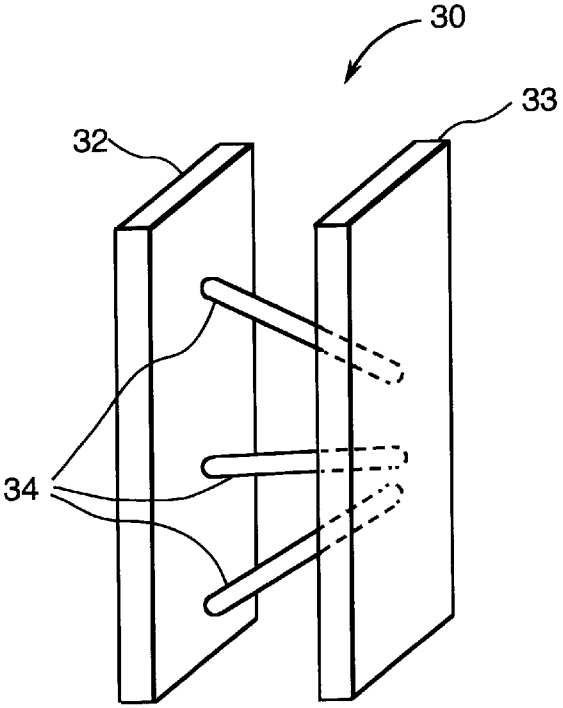
FIG. 3 is a side perspective view of a preformed ceramic spacer device, in accordance with a third preferred embodiment of the invention.

FIG. 3 illustrates a third preferred embodiment of the preformed ceramic spacer device in accordance with the invention. According to the third preferred embodiment of the invention, the preformed ceramic spacer device 30 comprises opposed end plates 32 and 33, which are connected by a series of interconnecting pins 34. The series of interconnecting crossover pins 34 are circular in cross-section and aligned in a row. In this third preferred embodiment, illustrated in FIG. 3, each of pin in the series of interconnecting crossover pins 34 can intersect the plates 32 and 33 at non-right angles, such as pins 34*a* and 34*b*, right angles, such as pin 34*c* or a combination of right angles and non-right angles, as illustrated.

Figure 4:
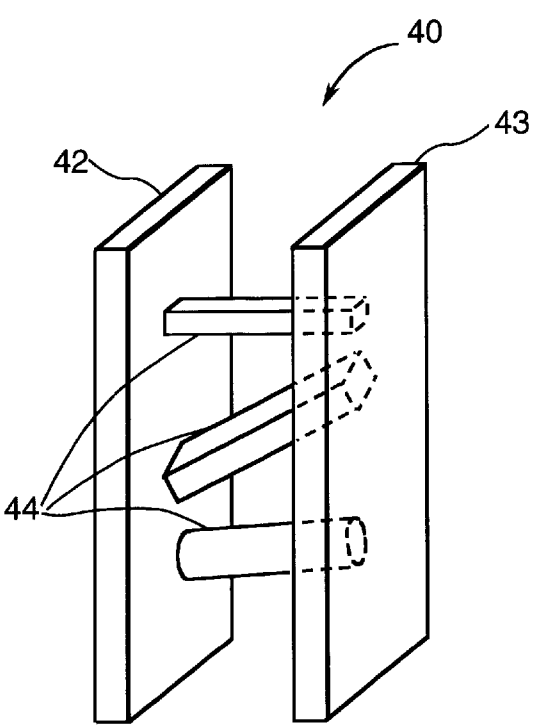
FIG. 4 is a side perspective view of a preformed ceramic spacer device, in accordance with a fourth preferred embodiment of the invention.

FIG. 4 illustrates a fourth preferred embodiment of the preformed ceramic spacer device in accordance with the invention. The preformed ceramic spacer device 40, according to the fourth preferred embodiment of the invention, comprises opposed end plates 42 and 43, which are connected by a series of interconnecting pins 44. The series of interconnecting crossover pins 44 have differing cross-sections, including a circular cross-section, square cross section and rectangular cross-section. However, with all of the preferred embodiments, the shape of the cross-section of the interconnecting crossover pins can be any appropriate cross-section, as long as the structural integrity of the pins and the preformed ceramic spacer device is maintained.

Figure 5:
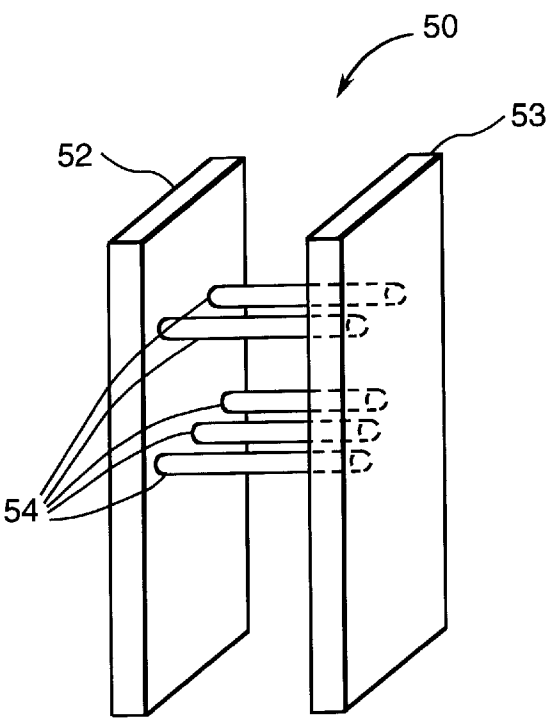
FIG. 5 is a side perspective view of a preformed ceramic spacer device, in accordance with a fifth preferred embodiment of the invention.

A fifth preferred embodiment, in accordance with the invention, is illustrated in FIG. 5. The preformed ceramic spacer device 50 comprises a series of interconnecting crossover pins 54 formed in a plurality of rows or columns, dependent on the orientation of the preformed ceramic spacer device 50. Although FIG. 5 illustrates two rows or columns, each with a differing number of pins. As discussed above, the preformed ceramic spacer device, in accordance with the invention, can be formed with any number of rows or columns, each with any number of pins in the row or column, of the series of interconnecting crossover pins 54.

In the fifth preferred embodiment of FIG. 5, each pin in the series of interconnecting crossover pins 54 are illustrated intersecting the plates 52 and 53 at right angles. However as in the above preferred embodiments, each pin of the series of interconnecting pins 54 can intersect the plates 52 and 53 at any appropriate angle, right angles, a combination of right angles and non-right angles, as in FIG. 3. Further, the cross-sections of each pin of the series of interconnecting crossover pins 54 are illustrated with a circular cross-section, however each can have any appropriate cross-section, as discussed above.

Figure 6:
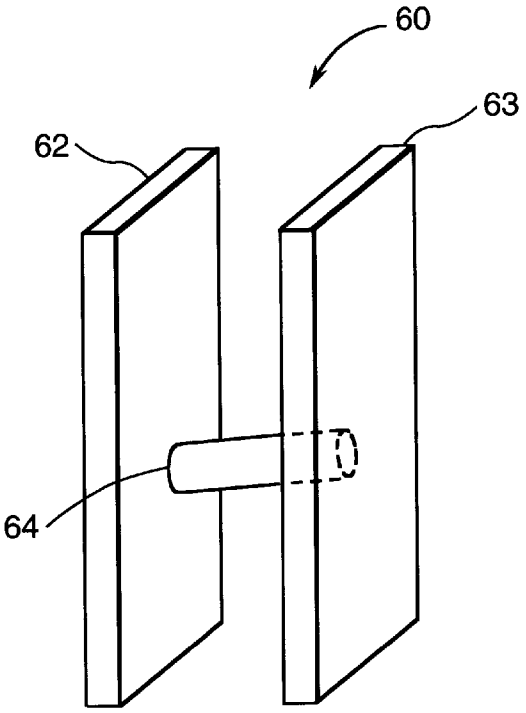
FIG. 6 is a side perspective view of a preformed ceramic spacer device, in accordance with a sixth preferred embodiment of the invention.

FIG. 6 illustrates a sixth preferred embodiment of the preformed ceramic spacer device in accordance with the invention. In FIG. 6, the preformed ceramic spacer device 60 comprises opposed end plates 62 and 63, which are connected by a single enlarged diameter interconnecting pin 64. The single enlarged diameter interconnecting crossover pin 64 is circular in cross-section. In this preferred embodiment, the single enlarged pin 64 has an enlarged diameter and intersects the plates 62 and 63 at a right angles as illustrated. However, the cross section and angle of intersection with the plates 62 and 63 can take any appropriate form, as discussed above with respect to the other preferred embodiments.

While the above described various configuration for preformed ceramic spacer devices, the invention pertains to and is directed to various combinations of elements, variations or improvements of the preformed ceramic spacer devices, that are within the scope of the invention.

Further, although in each of the above preferred embodiments, the end plates are illustrated as rectangular, the shape of the end plates can take any shape consistent with the invention, while maintaining the structural integrity of the preformed ceramic spacer device. The end plate may have any appropriate shape, and the illustrated shapes are merely illustrative, and are not meant in any way to limit the invention.

Further, the passage formed by the interconnecting crossover pins may be any appropriate passage, including but not limited to aligned, offset laterally or offset longitudinally from each other. These are merely exemplary and not meant to limit the invention in any way.

A description of methods for forming walls in airfoils using the above described preformed ceramic spacer devices will now be provided. Although the following description refers to the preformed ceramic spacer device of FIG. 1, this is not meant to limit the invention in any respect. Any of the preformed ceramic spacer devices, including various disclosed combinations of elements, variations or improvements that are within the scope of the invention, can be used in accordance with the methods described herein.

A first preferred method, in accordance with the invention, for forming an airfoil that has a controlled wall thicknesses and comprises surface cooling holes, is illustrated in FIGS. 7A–13. FIGS. 7A–7C, 8A–8D and 9 illustrate various close up views of preferred methods using preformed ceramic spacer devices, in accordance with the invention.

Figure 7C:
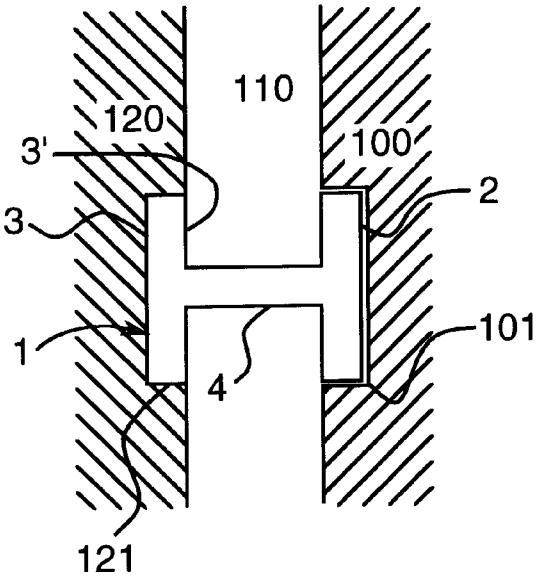
FIGS. 7A–7C are close-up sectional drawings illustrating a first preferred method for assembling a preformed ceramic spacer device, core, and mold, in accordance with the invention.
Figure 7B:
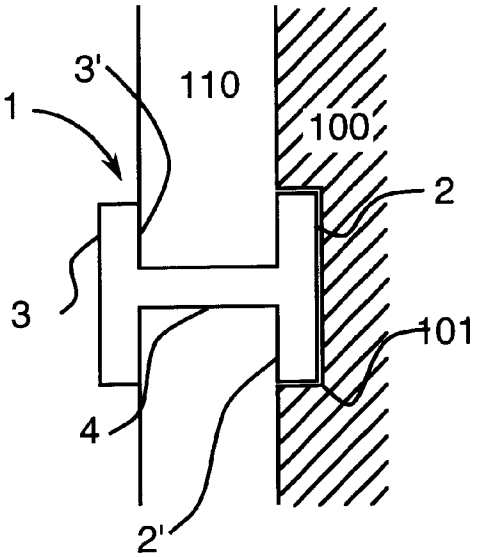
Figure 7A:
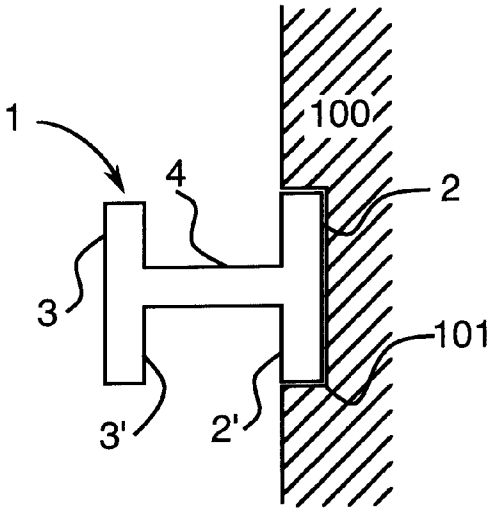
Figure 10:
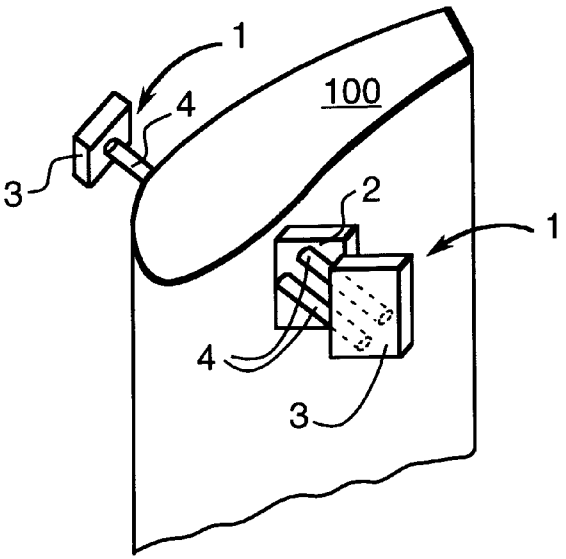
FIG. 10 is a side cross sectional view of a turbine blade or bucket with preformed ceramic spacer devices positioned on a core, in accordance with the invention.
Figure 11:
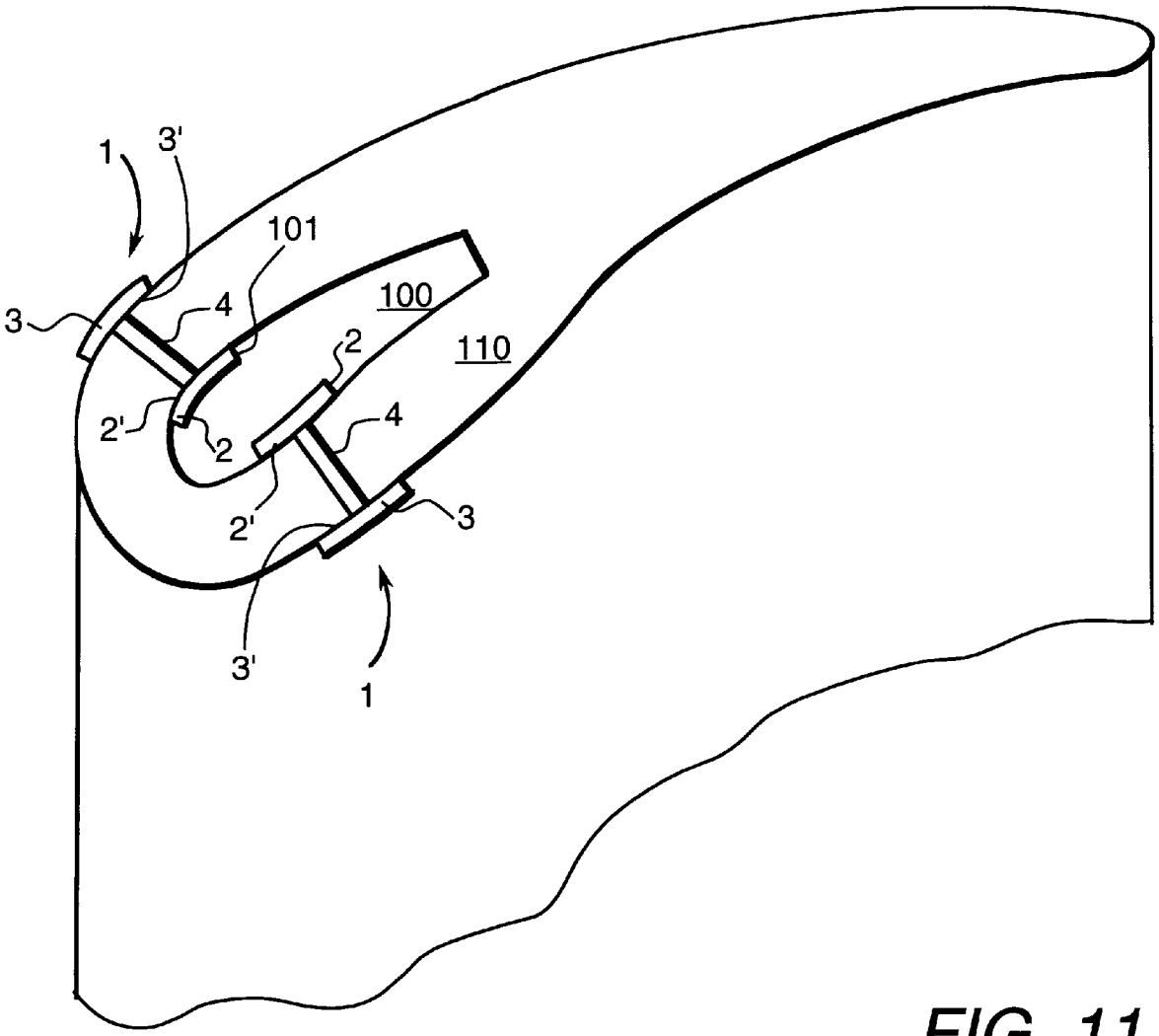
FIG. 11 is a side cross sectional view of turbine blade or bucket with a preformed ceramic spacer device positioned on a core, with wax positioned on the preformed ceramic spacer devices, in accordance with the invention.
Figure 12:
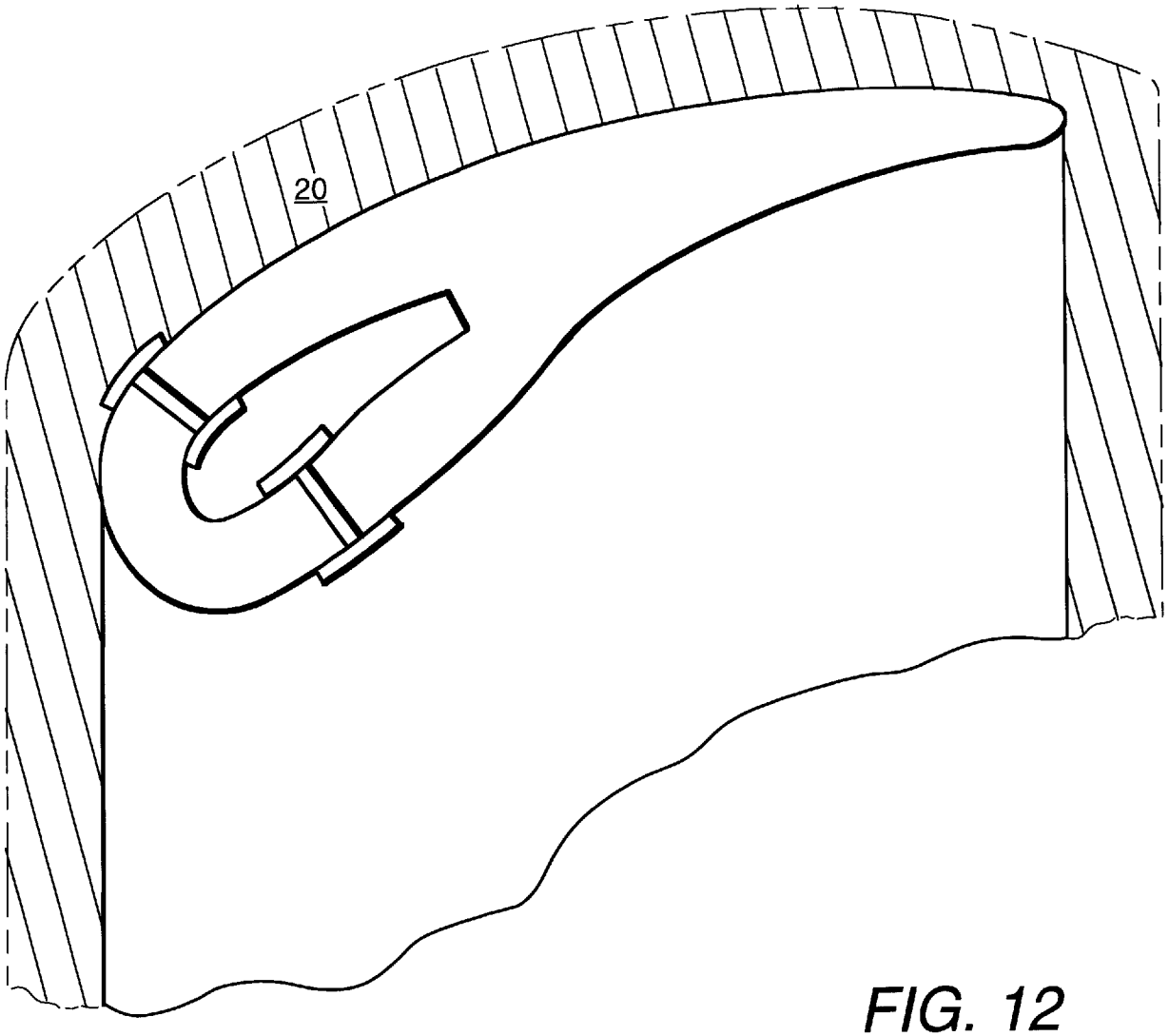
FIG. 12 is a side cross sectional view similar to FIG. 11 with a mold formed over the wax, in accordance with the invention.

With reference to the figures, in particular FIGS. 10–12, which correspond to FIGS. 7A–7C, a preformed ceramic spacer device 1 is positioned on a core 100. The core 100 may comprise a groove or depression 101, which is sized to receive therein one end plate of the preformed ceramic spacer device 1, here illustrated as plate 2. The groove or depression 101 positions and retains the respective plate 2 and prevents the preformed ceramic spacer device 1 from shifting transverse on the core 100. The size, shape, volume and area of the groove or depression 101 should approximate the size, shape, volume and area of the plate 2. However, the groove or depression 101 need not exactly fit the plate 2, as long as the end plate 2 fits therein (FIG. 7A). As described hereinafter, the formation of a layer of temporary material 110, such as but not limited to wax, and a shell mold or mold 120 will assure that the preformed spacer device 1 is stably maintained with respect to the core 100.

When the preformed ceramic spacer device 1 is positioned on the core 100 (FIG. 10), a layer of temporary material 110 (the layer of temporary material 110 will be referred to hereinafter as wax 110, however this is merely exemplary and is meant to limit the invention in any way), or any other appropriate material, is placed over the core 100 and surrounding the preformed ceramic spacer device 1 (FIGS. 7B and 11). The wax 110 is placed on the core 100 at a depth to be intermediate the plates 2 and 3 of the preformed ceramic spacer device 1. The wax 110 lies substantially coplanar with inner surfaces 2' and 3' of the plates 2 and 3, respectively. The inner surfaces 2' and 3' are adjacent the interconnecting crossover pins 4.

The wax 110 may be placed over the core 100 by any known manner, including injection molding, coating, dipping, spraying, and painting. This list of methods is exemplary and is not meant to limit the invention is any way. Further, the wax 110 may take any appropriate composition, and the type of wax is not seen to be limit the invention in any manner.

The wax 110 is formed over the core 100 and all around the preformed ceramic spacer device 1 to encompass the preformed ceramic spacer device 1. The wax 110 is formed to be essentially coplanar with the inner surfaces 2' and 3', as illustrated in FIGS. 7A and 7B. In these figures, the preformed ceramic spacer device 1 is placed in a groove or depression 101 in the core 100 and the wax 110 is placed on the core 100 to substantially encompass the preformed ceramic spacer device 1, except for the end plate 3. Thus, the mated structures, the core 100, preformed ceramic spacer device 1 and wax 110, form an article that is ready to be provided with a shell mold or mold 120.

Figure 8D:
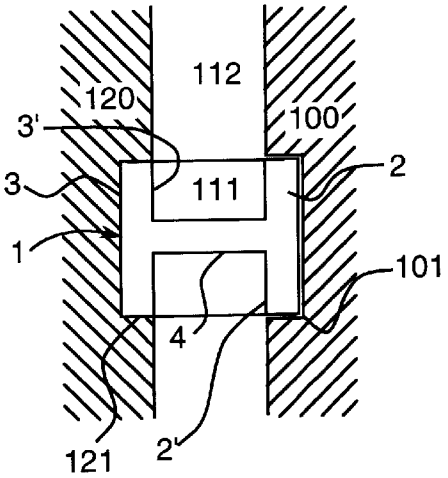
FIGS. 8A–8D are close-up sectional drawings illustrating a second method for assembling a preformed ceramic spacer device, core, and mold, in accordance with the invention.
Figure 8C:
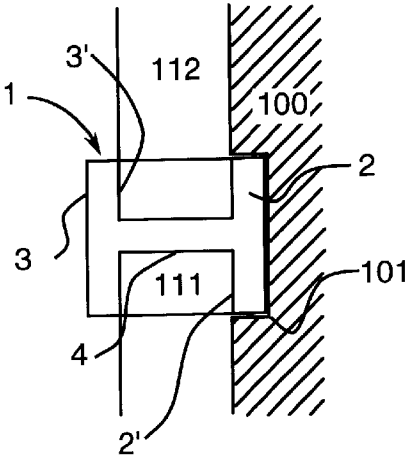
Figure 8B:
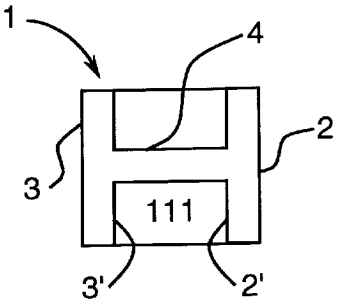

On the other hand, as illustrated in FIGS. 8A–8D, wax 111 may be initially placed between the plates 2 and 3 of the preformed ceramic spacer device 1 (FIG. 8B). A partial layer of wax 112 can also be placed on the core 100 on all areas, except for voids or spaces 105 (FIG. 8A), which covers the grooves or depressions 101, if provided. Alternatively, if no depressions are provided on the core 100, the wax 112 can also be placed on the core 100 on all areas, except for areas where the preformed ceramic spacer devices 1 will be positioned. At these areas on the core 100, voids or spaces 105 are provided to receive the preformed ceramic spacer device 1.

The wax 110 (FIG. 7A) or 111 and 112 (FIGS. 8A–8D) (however the following description will only refer to wax 110 to facilitate the description) substantially stabilizes the preformed ceramic spacer device 1 on the core 100, regardless of a depression 101 in the core 100. Although a depression 101 provides a relatively stable positioning of the preformed ceramic spacer device 1 on the core 100, if the depression 101 is not provided, the wax 110 and shell mold or mold 120 will stably position the preformed ceramic spacer device 1 on the core 100.

Figure 8A:
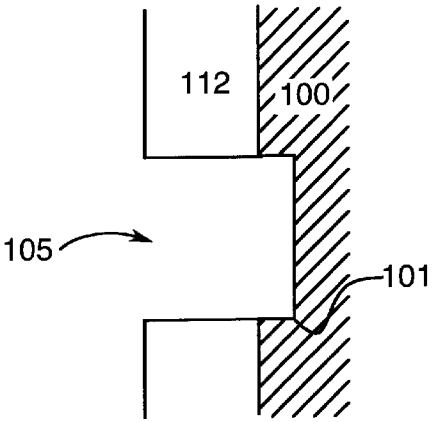

In this situation, the preformed ceramic spacer device 1 will be formed and then wax 111 is positioned between the plates 2 and 3, so as to be substantially coplanar with the inner surfaces 2' and 3'. Then the preformed ceramic spacer device 1 with the wax 111 can be mated into the voids or spaces 105 in the core 100 and wax 112 structure (FIG. 8A). Thus, the mated structures form an article that is readily for being provided with a shell mold or mold 120.

A shell mold or mold 120 can then be positioned over the wax 110 (FIGS. 7C, 8D and 12). The shell mold or mold 120 may be formed of any appropriate material that is able to provide a stable form and maintain its shape and integrity when contacted with liquid metal, as described hereinafter. The shell mold or mold 120 is formed over the wax 110 by any suitable manner and by any appropriate method.

As seen in FIGS. 7C and 8D, the shell mold or mold 120 forms an overlying layer on the wax 110, and comprises a groove or depression 121. The depression 121 is formed by one of the plates 2 or 3 of the preformed ceramic spacer device 1, where the end plate is the one opposite the end plate contacting the core 100. By forming the shell mold or mold 120 on the wax 110 and preformed ceramic spacer device 1, the groove or depression 121, which is formed in the shell mold or mold 120, will conform very closely in area, volume, shape and size to the respective plate.

After the shell mold or mold 120 is formed and stabilized on the layer of wax 110, the wax 110 will be removed to form a cavity. The wax 110 can be removed by any appropriate method, for example by heating the structure above the melting temperature of the wax 110. This permits the wax 110 to liquefy and be removed through drain holes (not illustrated). Therefore, this results in the formation of an airfoil cavity.

Figure 13:
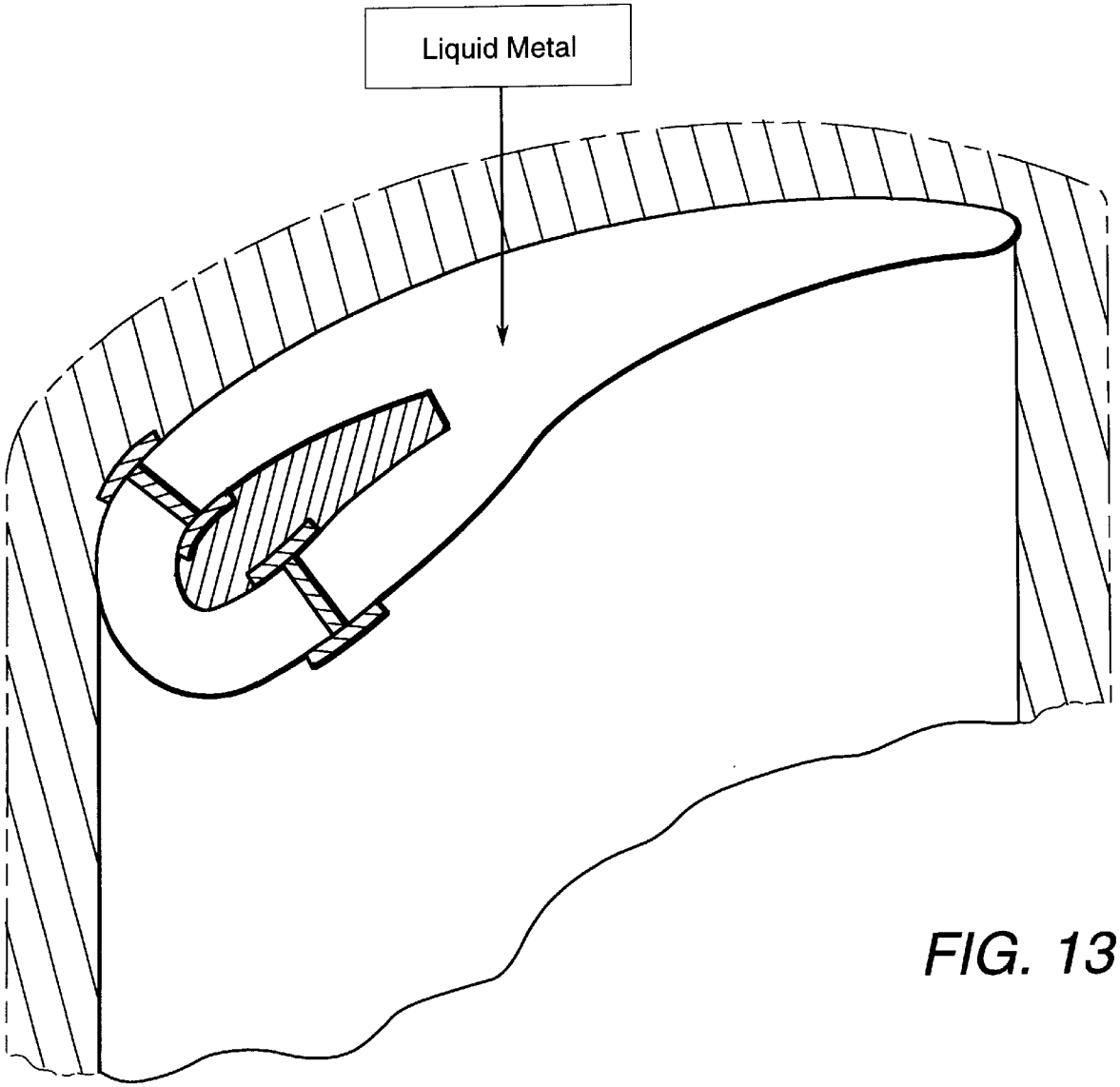
FIG. 13 is a side cross sectional view similar to FIG. 12 with the wax removed and illustrating introduction of liquid metal into a void created by removed wax so as to form the cast product, in accordance with the invention.

The airfoil cavity is illustrated in FIG. 13. The cavity is defined by and comprises the core 100, preformed ceramic spacer device or devices 1 and the shell mold or mold 120. A blade or vane space 140 positioned in between the shell mold or mold 120 and the core 100. The blade or vane space 140 defines the wall of a cast product, here a turbine blade or vane.

After the airfoil cavity has been formed, a suitable liquid metal, alloy or other material is placed into the space 140. For example, a liquid metal material can be poured into the cavity through an appropriate entry port (not illustrated), as known in the art.

Once the liquid metal solidifies, the shell mold or mold 120 is removed, to result in a metal vane or blade surrounding the core 110. The preformed ceramic spacer devices 1 will protrude through the vane or blade, with the plate 3 being exposed, as illustrated. At this point, the preformed ceramic spacer device 1 and the core 100 are removed, by any appropriate process known in the art, for example by etching, leaching and other analogous methods known in the art. However, these are merely exemplary of the methods that can be employed to remove the preformed ceramic spacer devices 1 and core 100, and is not meant to limit the invention in any manner.

The removal of the core 100 and preformed ceramic spacer device 1 results in the creation of at least one surface cooling hole on the vane or blade. Depending on the number of preformed ceramic spacer devices 1 used, any number of surface cooling holes can be formed on the vane or blade.

Figure 9:
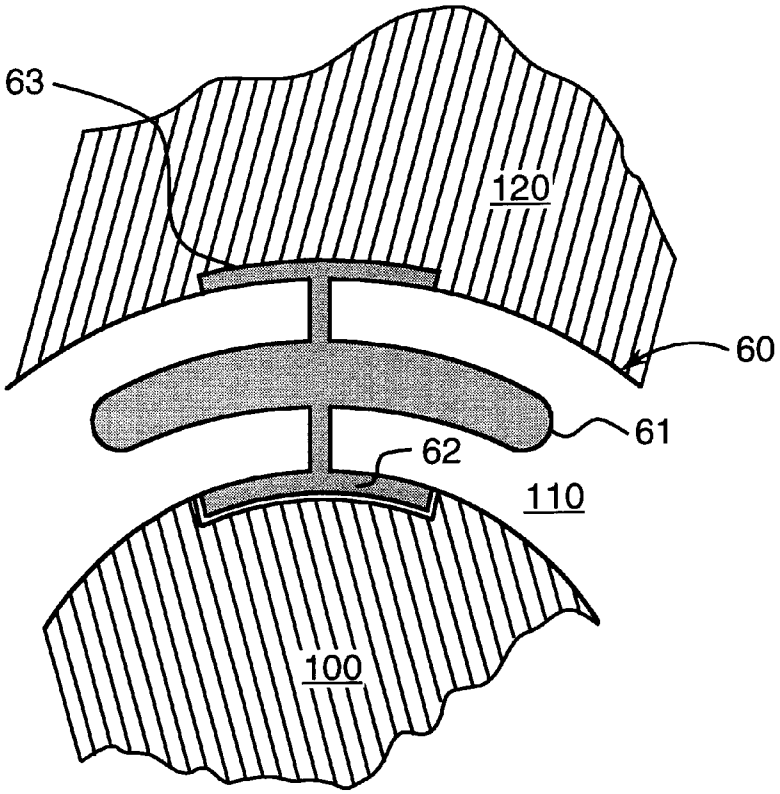
FIG. 9 is a side perspective view of a preformed ceramic device in cooperation with a core and mold, in accordance with a further preferred embodiment of the invention.

Further, as shown in FIG. 9, a preformed ceramic spacer device 60 may include an enlarged portion 61 formed on or in conjunction with an interconnecting crossover pin 64. The enlarged portion 61, when removed from the vane or blade as described above, forms a part of a cooling passage for the airfoil to deliver cooling fluid, as is known in the art. The shape, size and volume of the enlarged portion 61 can take any appropriate construction, dependent on the intended use of the vane or blade and the type of cooling fluid.

Further, in FIG. 9, the plates 62 and 63 of the preformed ceramic spacer device 60 are curved. Therefore, when the wax 110 is removed as described above, the cavity is formed with curved surfaces. Although FIG. 9 illustrates the plates 62 and 63 with a curved profile, the shape and profile of the plates 62 and 63 can take any appropriate shape and profile dependent on the intended use of the vane or blade and its desired end profile and shape, as long as its structural integrity is maintained.

Figure 14:
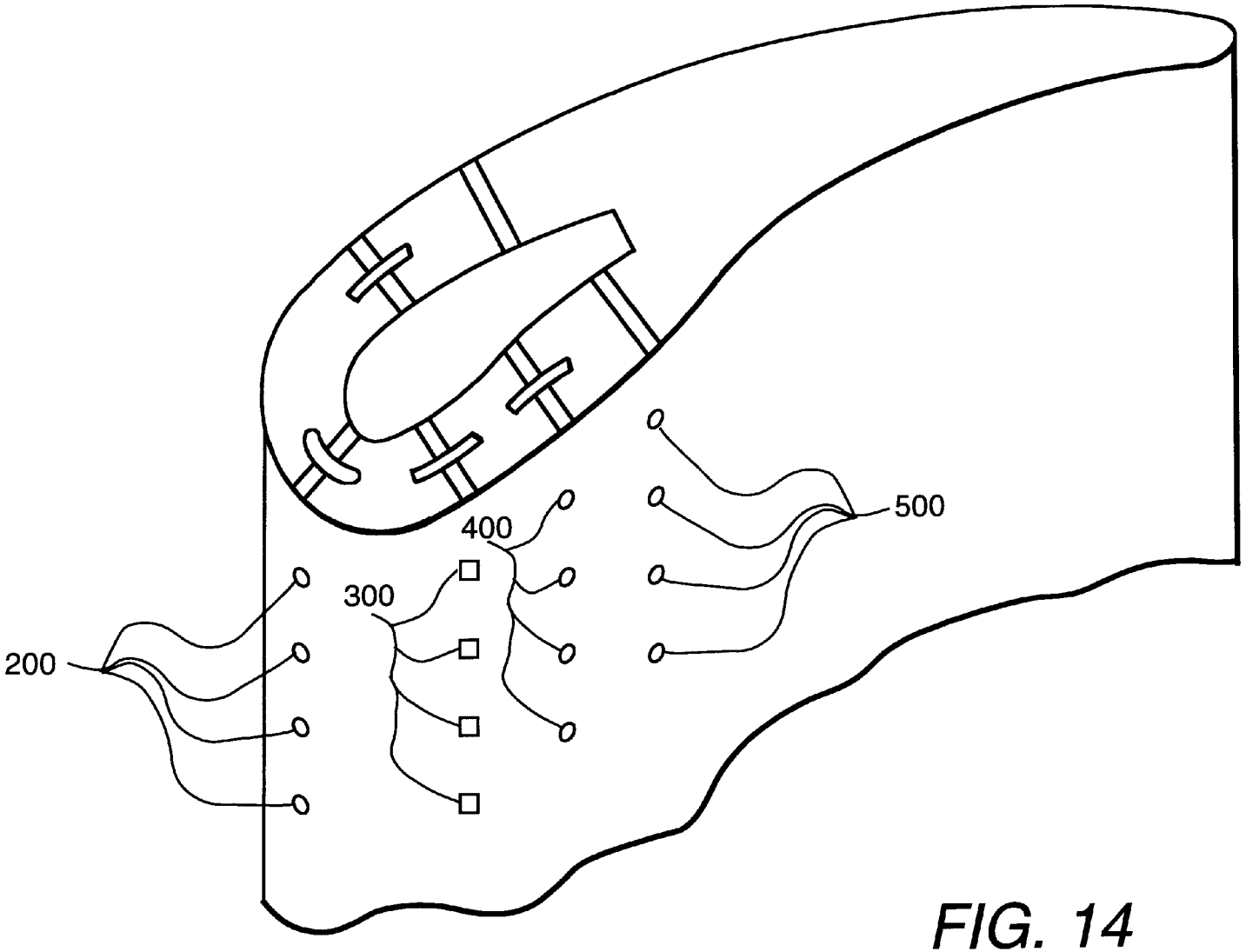
FIG. 14 is an example of a turbine blade or bucket with the mold removed and also with preformed ceramic spacer devices and core removed, in accordance with the invention.

FIG. 14 illustrates a cross section of one vane or blade formed in accordance with the invention. The vane or blade comprises a series of surface cooling holes 200, 300, 400 and 500. In FIG. 14, the surface cooling holes have been formed by differing preformed ceramic spacer devices used in accordance with the invention. For example, surface cooling holes 200 have been formed by a preformed ceramic spacer device as in FIG. 9, in accordance with the invention; surface cooling holes 300 have been formed by a preformed ceramic spacer device with a rectangular cooling passage and rectangular interconnecting crossover pins, in accordance with the invention; surface cooling holes 400 have been formed by a preformed ceramic spacer device as in FIG. 9 but with an inverted cooling passage, in accordance with the invention; and surface cooling holes 500 have been formed with a preformed ceramic spacer device as in FIG. 1, in accordance with the invention.

However, the vane or blade in FIG. 14 is merely exemplary and not meant to limit the invention in any way. Any number of preformed ceramic spacer devices can be use and they can have any shape and form, in accordance with the invention.

The preformed ceramic spacer device, including the end plates and the interconnecting crossover pins, define the spacing between the core and mold. This accurately forms the wall space for casting a blade or vane in an airfoil, with an acceptable tolerance. Since the preformed ceramic spacer device stably supports and connects the core 100 and the shell mold or mold 120, regardless of the shape of each, the formed article will have a well defined thickness, as the shell mold or mold 120 and core 100 will not move with respect to each other. Further, the end plates strengthen the interconnecting crossover pins and prevent breakage of the pins during fabrication and casting.

While the embodiments described herein are preferred, it will be appreciated from the specification that various disclosed combinations of elements, variations or improvements therein may be made by those skilled in the art that are within the scope of the invention.

What is claimed is:

1. A method for casting a turbine component with at least one surface cooling hole, the turbine component having a wall, the method for casting comprising:

positioning at least one preformed spacer device on an outer surface of a core, the at least one preferred spacer device comprises opposed end plates and at least one interconnecting crossover pin connecting the opposed end plates;

forming a layer of temporary material over the core and around the at least one preformed spacer device;

forming a shell mold over the layer of temporary material to cover the layer of temporary material and the core and the at least one preformed spacer device;

maintaining the shell mold stably positioned and spaced from the core by the at least one preformed spacer device, the at least one preformed spacer device connecting and maintaining the shell mold and the core as a stable body;

removing the layer of temporary material from between the shell mold and the core and from around the at least one preformed spacer device to form a cavity for the turbine component between the shell mold and the core and around the at least one preformed spacer device;

placing a liquid metal material, from which the turbine component will be formed, into the cavity between the shell mold and the core and around the at least one preformed spacer device; and removing the shell mold, the core and the at least one preformed spacer device, once the liquid metal material has hardened, to form the cast turbine component having the wall, where the removing of the at least one preformed spacer device creates the at least one surface cooling hole on the surface of the turbine component.

2. The method of claim 1, wherein the positioning of the at least one preformed spacer device comprises positioning a plurality of preformed spacer devices.

3. The method of claim 1, wherein the positioning the at least one preformed spacer device comprises positioning one of the opposed end plates on the outer surface of the core.

4. The method of claim 3, wherein the at least one preformed spacer device comprises a plurality of interconnecting crossover pins.

5. The method of claim 1, wherein the at least one preformed spacer device is formed from ceramic materials.

6. The method according to claim 1, wherein the core comprises at least one depression; and the positioning of the at least one preformed spacer device further comprises:

positioning the at least one preformed spacer device in a respective at least one depression on the outer surface of the core, wherein the number of the at least one preformed spacer devices equals the number of the at least one depressions.

7. The method according to claim 6, wherein a size, shape, area and volume of the at least one depression substantially equals a size, shape, area and volume of an end plate of the at least one preformed spacer device.

8. The method according to claim 1, the core comprises at least one depression; and the positioning of the at least one preformed spacer device further comprises positioning the at least one preformed spacer device in a respective at least one depression on the outer surface of the core, wherein the number of the at least one preformed spacer devices does not equal the number of the at least one depressions.

9. The method of claim 1, the removing of the shell mold, the at least one preformed spacer device and the core comprises one of etching and leaching of the shell mold, the at least one preformed spacer device and the core to result in the cast turbine component with the wall and having at least one surface cooling hole.

10. The method of claim 1, the removing the of the shell mold, the at least one preformed spacer device and the core comprises forming at least one surface cooling hole on the surface of the cast turbine component.

11. The method of claim 1, wherein:

the forming the layer of temporary material on the core and around the at least one preformed spacer device comprises forming the layer of temporary material between opposed inner wall surfaces of the opposed end plates; and the removing the shell mold, the at least one preformed spacer device and the core forms a cast turbine component with substantially smooth and regular surfaces.

12. The method according to claim 1, the at least one preformed spacer device further comprises a cooling channel enlarged portion positioned on one or more of the at least one interconnecting crossover pins;

wherein the removing the shell mold, the at least one preformed spacer device and the core forms a cast turbine component with an internal cooling passage.

13. The method according to claim 1, wherein the layer of temporary material is wax.

14. The method of claim 1, the method further comprising:

positioning temporary material on the at least one spacer device between the opposed end plates prior to the positioning of the at least one preformed spacer device on the outer surface of the core; and the forming a layer of temporary material further comprises positioning a partial layer of temporary material on surfaces of the core prior to the positioning of the at least one spacer on the core and creating insertion spaces where the core is free of the partial layer of temporary material, the at least one spacer with the temporary material thereon on the core being placed on the core in the insertion spaces.

* * * * *